US010991566B2

(12) United States Patent
Kudo

(10) Patent No.: US 10,991,566 B2
(45) Date of Patent: Apr. 27, 2021

(54) TIME-OF-FLIGHT MASS SPECTROMETER

(71) Applicant: SHIMADZU CORPORATION, Kyoto (JP)

(72) Inventor: Tomoya Kudo, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/755,949

(22) PCT Filed: Dec. 4, 2017

(86) PCT No.: PCT/JP2017/043392
§ 371 (c)(1),
(2) Date: Apr. 14, 2020

(87) PCT Pub. No.: WO2019/111290
PCT Pub. Date: Jun. 13, 2019

(65) Prior Publication Data

US 2020/0243320 A1 Jul. 30, 2020

(51) Int. Cl.
*H01J 49/40* (2006.01)
*H01J 49/24* (2006.01)
*H01J 49/44* (2006.01)

(52) U.S. Cl.
CPC ..... *H01J 49/40* (2013.01); *H01J 49/24* (2013.01); *H01J 49/446* (2013.01)

(58) Field of Classification Search
CPC ..... H01J 49/40; H01J 49/24; H01J 49/446
(Continued)

(56) References Cited

U.S. PATENT DOCUMENTS 6,316,768 B1 * 11/2001 Rockwood ..... H01J 49/40 250/287
2012/0068064 A1 3/2012 Numata
(Continued)

FOREIGN PATENT DOCUMENTS

| | | | |
|---|---|---|---|
| JP | 2003-068246 | A | 3/2003 |
| JP | 2012-064437 | A | 3/2012 |
| WO | 2017/064802 | A1 | 4/2017 |

OTHER PUBLICATIONS

International Search Report for PCT/JP2017/043392 dated Jan. 30, 2018 (PCT/ISA/210).

(Continued)

*Primary Examiner* — Kiet T Nguyen
(74) *Attorney, Agent, or Firm* — Sughrue Mion, PLLC

(57) ABSTRACT

Inside a chamber (10) evacuated by a vacuum pump, a flight tube (12) is held via a support member (11) that is of insulation. The outside of the chamber (10) is surrounded by a temperature control unit (16) including a heater. A body (10*a*) of the chamber (10) is made of aluminum, and a coating layer (10*b*) by a black nickel plating is formed on the inner wall surface of the body (10*a*) of the chamber (10). Due to this, the radiation factor of the chamber (10) becomes higher than that of a conventional apparatus using only aluminum, and the thermal resistance of the radiation heat transfer path between the chamber (10) and the flight tube (12) becomes low, thus improving the temperature stability of the flight tube (12). Furthermore, the time constant of the temperature change of the flight tube (12) becomes small, thus reducing the time for the flight tube (12) to stabilize to a constant temperature.

11 Claims, 1 Drawing Sheet

(58) Field of Classification Search
USPC ..... 250/287
See application file for complete search history.

(56) References Cited

U.S. PATENT DOCUMENTS

2015/0014524 A1* 1/2015 Chiappetta ..... H01J 49/405
250/287
2018/0358215 A1 12/2018 Yamaguchi

OTHER PUBLICATIONS

Written Opinion for PCT/JP2017/043392 dated Jan. 30, 2018 (PCT/ISA/237).

* cited by examiner

TIME-OF-FLIGHT MASS SPECTROMETER

CROSS REFERENCE TO RELATED APPLICATIONS

This application is a National Stage of International Application No. PCT/JP2017/043392 filed Dec. 4, 2017.

TECHNICAL FIELD

The present invention relates to a time-of-flight mass spectrometer.

BACKGROUND ART

Generally, in a tune-of-flight mass spectrometer (hereinafter sometimes referred to as TOFMS), a certain acceleration energy is given to ions derived from a sample component and the ions are introduced into a flight space formed in a flight tube, thus causing them to fly in the flight space. Then, the time required for each ion to fly a certain distance is measured, and the mass-to-charge ratio m/z of each ion is calculated based on the flight time. Therefore, when the flight distance changes due to thermal expansion of the metal flight tube with an crease in the ambient temperature, the flight time of each ion also changes, resulting in a difference in the mass-to-charge ratio. In order to achieve high mass accuracy by avoiding a mass difference caused by thermal expansion of the flight tube, various measures have been attempted conventionally.

As disclosed in Patent Literatures 1, 2, and the like, a method of correcting, by data processing, a mass difference caused by thermal expansion of the flight tube is also known, but it is difficult to obtain a sufficient correction effect if the mass difference is large. Therefore, in order to achieve high mass accuracy, it is important to suppress the thermal expansion itself of the flight tube to some extent regardless of whether or not correction by such data processing is performed.

As a method of suppressing thermal expansion of the flight tube, there is a method of manufacturing the flight tube itself from a material having a low thermal expansion coefficient. Patent Literatures 2 and 3 describe use of Fe—Ni 36% (Invar: registered trademark) having a low thermal expansion coefficient as a material for a flight tube. However, as described in Patent Literature 3, the cost of the apparatus is significantly increased because such a material having a low thermal expansion coefficient is considerably more expensive than stainless steel or the like.

On the other hand, Patent Literatures 2 and 3 disclose a method of placing a flight tube in a container (chamber) that is temperature-controlled or free from an influence of external temperature change so that the temperature of the flight tube changes as little as possible even if the ambient temperature changes. Since the inside of a chamber is in a high vacuum state, thermal coupling between the chamber and the flight tube is dominated by radiation heat transfer. However, other than that, there is thermal coupling between the chamber and the flight tube by heat conduction or the like through a member or members that structurally support the flight tube with respect to the inner wall of the chamber, i.e., a member or members in contact with both the chamber and the flight tube, or the like. That is, a flight tube disposed inside a vacuum chamber is still affected by temperature change outside the chamber due to radiation heat transfer, heat conduction, and the like. Therefore, in order to enhance the temperature stability of the flight tube, it is necessary to control the temperature of the chamber by a heater or the like disposed outside the chamber.

CITATION LIST

Patent Literature

Patent Literature 1: WO 2017/064802 A
Patent Literature 2: JP 2003-68246 A
Patent Literature 3: JP 2012-64437 A

SUMMARY OF INVENTION

Technical Problem

In recent years, mass spectrometers have been required to have improved mass accuracy and resolution more than ever before. Therefore, further stability of the temperature of the flight tube is important in TOFMS. Although it is possible to improve the temperature stability of the flight tube by improving the temperature control performance of the chamber itself or it is possible to use a material having a low thermal expansion for the flight tube as described above, there is a problem in those cases that the cost greatly increases, and the apparatus increases in size and weight.

The present invention has been made to solve such problem, and its object is to provide a TOFMS capable of achieving high mass accuracy by increasing the temperature stability of the flight tube without significantly increasing the cost.

Solution to Problem

Generally, in TOFMS, aluminum or stainless steel is used for the chamber, and stainless steel is used for the flight tube. The radiation factor of stainless steel is as low as about 0.3, and the radiation factor of aluminum is even lower, equal to or less than 0.1. When the radiation factor is this low, the thermal coupling between the chamber and the flight tube due to radiation heat transfer is small. That is, the thermal resistance in the path of the radiation heat transfer is large. If the thermal resistance in the path of radiation heat transfer becomes significantly larger than that in the path of heat conduction, the temperature of the flight tube becomes difficult to stabilize even if the temperature of the chamber is controlled to be constant. This is because when the room temperature fluctuates, temperature change is transmitted to the flight tube through a heat conduction path that has not been sufficiently controlled, and the flight tube is not maintained at a constant temperature. In order to enhance the stability of temperature control against such a disturbance of room temperature fluctuation, it is necessary to make the thermal resistance in the path of radiation heat transfer sufficiently smaller than that in the path of heat conduction.

Based on the above findings, the present inventor has conceived of increasing the temperature stability of the flight tube by minimizing the thermal resistance in the path of radiation heat transfer, and has achieved the present invention.

That is, the present invention is a time-of-flight mass spectrometer including: a chamber whose inside is maintained in vacuum; a flight tube disposed inside of the chamber and separated from an inner wall of the chamber; and a temperature control unit configured to control temperature outside the chamber, wherein a radiation factor improvement treatment is done to a part of an inner wall surface of the chamber facing the flight tube.

In the TOFMS according to the present invention, thermal coupling between the chamber and the flight tube owing to the radiation heat transfer is increased by doing a predetermined radiation factor improvement treatment to a part of the inner wall surface of the chamber facing the flight tube. Thus, the thermal coupling due to the radiation heat transfer can be relatively increased as compared with thermal coupling due to heat conduction through a support member provided so as to come into contact with both the flight tube and the chamber for holding the flight tube in the chamber, for example. As a result, the temperature of the flight tube can be maintained stably by the radiation heat transfer even if the room temperature changes and the change is conducted to the flight tube via a support member or the like whose temperature is not sufficiently controlled by the temperature control unit, for example.

The time required for the flight tube to stabilize to a constant temperature at the start of temperature control or the like by activation of the apparatus (hereinafter referred to as "temperature stabilization time") depends on a time constant $\tau$ of the temperature change of the flight tube. The time constant $\tau$ is represented by the formula $\tau \approx$[thermal resistance in the heat transfer path]×[heat capacity of the flight tube]. If the radiation factor of the chamber is low, the thermal resistance in the path of radiation heat transfer becomes high, and hence the time constant $\tau$ also becomes high and the temperature stabilization time of the flight tube becomes long. Then, at the time of starting the TOFMS, the length of time for the TOFMS to be ready to start measurement becomes long, thus resulting in reduction of the measurement efficiency. On the other hand, with the TOFMS according to the present invention, the thermal resistance in the path of radiation heat transfer is reduced by increasing the radiation factor of the chamber, and hence the time constant $\tau$ is reduced accordingly and the temperature stabilization time of the flight tube can be shortened.

In the present invention, the radiation factor improvement treatment can be done by various treatment methods.

In an aspect of the present invention, the radiation factor improvement treatment can be a surface treatment for the inner Tall surface of the material forming the chamber.

The surface treatment roughly divided into a coating film formation treatment of forming a thin coating film on the surface by a plating treatment, painting or a paint coating treatment, a thermal spraying treatment, and the like, and a processing treatment of roughening (forming irregularities) the surface by chemically or physically shaving the surface.

When the chamber is made of aluminum, the surface treatment described above can be an alumite forming treatment. The surface treatment can be a nickel plating treatment. The surface treatment can be a carbon coating film formation treatment. In the case of an alumite forming treatment, the radiation factor can be further improved by performing a black alumite forming treatment, which is to make the surface black by a method such as coloring with a black dye after the alumite forming treatment. In the case of a nickel plating treatment, the radiation factor can be further improved by performing a black nickel plating treatment, which is to make the surface black by a method such as oxidation to black after the nickel plating treatment. The surface treatment can be a ceramic thermal spraying treatment.

In another aspect of the present invention, the radiation factor improvement treatment described above can be a treatment of attaching a thin plate or thin foil of another material to the inner wall surface of the material forming the part of the chamber. For example, in the case where the chamber is made of aluminum, a thin stainless steel plate may be attached to the inner wall surface of the chamber.

What treatment method to adopt may be determined in consideration of the influence of the gas (outgas) released from the product formed by the treatment under a vacuum atmosphere and cost, or the like.

Advantageous Effects of Invention

According to the TOFMS of the present invention, the temperature change of the flight tube can be suppressed even when the room temperature changes. The cost increase depends on the treatment method of the radiation factor improvement treatment described above, but in any case, the cost increase can be suppressed as compared with the case of using an expensive material such as invar for the flight tube, and high mass accuracy can be realized while suppressing the cost increase.

DESCRIPTION OF EMBODIMENTS

Hereinafter, a TOFMS according to an embodiment of the present invention will be described with reference to the accompanying drawings.

Figure 1:
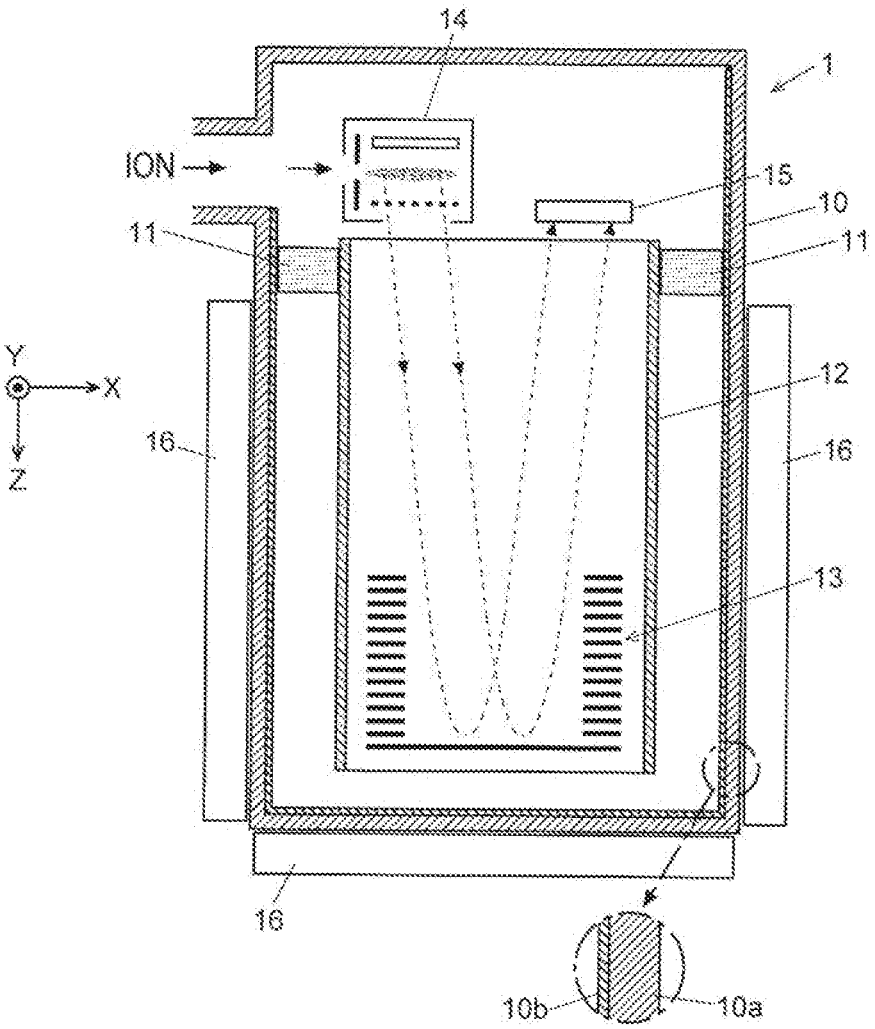
FIG. 1 is a schematic configuration diagram of a main part of a TOFMS according to an embodiment of the present invention.

FIG. 1 is a schematic configuration diagram of a main part of the TOFMS of the present embodiment.

The TOFMS of the present embodiment is a quadrupole-time-of-flight mass spectrometer (Q-TOFMS) including an ion source (not shown), a quadrupole mass filter (not shown), a collision cell (not shown), and an orthogonal acceleration TOFMS 1 appearing in and various product ions generated by dissociating precursor ions of a predetermined mass-to-charge ratio in the collision cell are introduced in the X direction from the left-hand side in FIG. 1.

In FIG. 1, inside a chamber 10 evacuated by a vacuum pump such as a turbo-molecular pump (not shown), a substantially cylindrical or square tubular flight tube 12 is held via a support member 11 having high insulation quality and high vibration absorption quality. An orthogonal acceleration unit 14 and an ion detector 15 are each fixed to the flight tube 12 via a support member (not shown). A reflector 13 constituted by a plurality of annular or rectangular annular reflection electrodes is disposed inside the flight tube 12 on a lower side, and a reflectron-type flight space in which ions are turned back by a reflection electric field formed by the reflector 13 is provided inside the flight tube 12.

The flight tube 12 is made of metal such as stainless steel, and a predetermined direct-current (DC) voltage is applied to the flight tube 12. Furthermore, different DC voltages are applied respectively to a plurality of reflection electrodes constituting the reflector 13 with reference to the voltage applied to the flight tube 12. Due to this, a reflection electric field is formed in the reflector 13, while the rest of the flight space is in a high-vacuum atmosphere free from an electric field or a magnetic field.

As shown in FIG. 1, when a pulsed DC voltage is externally applied to an acceleration electrode in the orthogonal acceleration unit 14 in a state where ions are introduced into the orthogonal acceleration unit 14 in the X direction, the ions are given predetermined kinetic energy in the Z direction by the DC voltage. This causes the ions to be sent from the orthogonal acceleration unit 14 into the flight space in the flight tube 12. The ions fly in the flight space through a trajectory shown by a dotted line in FIG. 1 and reach the ion detector 15. The velocity of an ion in the flight space depends on the mass-to-charge ratio of the ion. Thus, ions having different mass-to-charge ratios introduced into the flight space at substantially the same time are separated in accordance the mass-to-charge ratios during the flight, and reach the ion detector 15 with a time difference. A detection signal from the ion detector 15 is input to a signal processing unit (not shown), and a mass spectrum is generated by converting the flight time of each ion into a mass-to-charge ratio.

When the flight tube 12 expands due to heat, the flight distance changes, which results in an error in the mass-to-charge ratio. Therefore, in order to enhance the temperature stability of the flight tube 12, the TOFMS of the present embodiment is configured as follows.

The temperature of the chamber 10 is controlled to a predetermined temperature by a temperature control unit 16 including a heater and a temperature sensor disposed around the chamber. The flight tube 12 is heated so as to be maintained at a constant temperature mainly by radiation heat transfer from the temperature-controlled chamber 10, and the inner wall surface of the chamber 10 is provided with a surface treatment that enhances the radiation factor so as to increase the efficiency of radiation heat transfer. Specifically, in the present embodiment, the chamber 10 is made of aluminum, which is less expensive than stainless steel, and a coating layer 10*b* is formed by a black nickel plating treatment on the inner wall surface of a body 10*a* of the aluminum chamber 10 at least in a part facing the flight tube 12.

As is well known, black nickel plating is one of the most commonly used plating for anti-reflection and decoration purposes, and its processing cost is relatively inexpensive. When the coating layer 10*b* by black nickel plating is formed, the surface becomes black and the radiation factor is enhanced. The present inventor has experimentally confirmed that the radiation factor can be increased by about 10 times by forming the coating layer 10*b* by black nickel plating on the inner wall surface of the body 10*a* of the chamber 10 made of aluminum. Due to this, in the TOFMS of the present embodiment, the thermal resistance in the path of radiation heat transfer between the chamber 10 and the flight tube 12 is significantly reduced as compared with the conventional TOFMS (in the case where the coating layer 10*b* by black nickel plating is not formed), and the temperature stability of the flight tube 12 can be improved.

The present inventor has experimentally confirmed that in the TOFMS of the present embodiment, the amount of temperature change of the flight tube 12 with respect to the stepwise change in room temperature can be suppressed to about ½ as compared with the conventional TOFMS. On the other hand, it has been confirmed that it is possible to shorten the temperature stabilization time of the flight tube 12 by about 60% as compared with the conventional TOFMS.

In the above embodiment, in order to improve the radiation factor of the inner wall surface of the chamber 10, a coating laser by black nickel plating is formed. However, in the present invention, the treatment that improves the radiation factor is not limited to this.

For example, when the chamber 10 is made of aluminum as described above, normal nickel plating may be used instead of the black nickel plating, or a coating layer may be formed by an alumite forming treatment. Alternatively, a coating layer capable of improving the radiation factor may be formed on the surface of the chamber 10 by a carbon coating film formation treatment, a ceramic thermal spraying treatment, or another plating treatment, coating or a coating treatment, a thermal spraying treatment, or the like.

Figure 2:
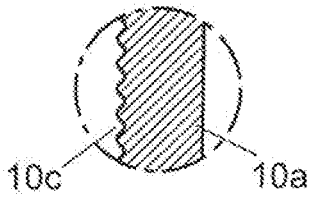
FIG. 2 is a schematic cross-sectional view of a chamber in a TOFMS according to another embodiment.

Furthermore, instead of forming a coating layer made of material different from that of the chamber 10, the surface of the chamber 10 itself may be chemically or physically shaved to form irregularities. FIG. 2 shows an example of an irregular surface 10*c* formed by such a processing treatment. This also increases the radiation factor of the inner wall surface of the chamber 10, and thus the same effects as in the above embodiment can be achieved.

Furthermore, instead of forming the coating layer by various types of processing treatments as described above, a thin plate or thin foil made of another material having a higher radiation factor than that of the material of the chamber 10 may be attached to the inner wall surface of the chamber 10. Specifically, a thin stainless steel plate may be attached to the inner wall surface of the chamber 10 made of aluminum as described above. This also increases the radiation factor of the inner wall surface of the chamber 10, and thus the same effects as in the above embodiment can be achieved.

The above embodiment is merely an example of the present invention, and it is obvious that modifications, alterations, additions, and the like appropriately made within the scope of the present invention, in addition to the above-described variations, and are included in the scope of claims of the present invention.

For example, although the above embodiment is a reflectron-type TOFMS of an orthogonal acceleration type, it is not necessary to be of an orthogonal acceleration type, and it may be a configuration in which ions emitted from an ion trap are introduced into the flight space or a configuration in which ions generated from a sample by a MALDI ion source or the like are accelerated and introduced into the flight space. A linear TOFMS may be used instead of the reflectron-type TOFMS.

REFERENCE SIGNS LIST

1 . . . Orthogonal Acceleration TOFMS
10 . . . Chamber
10*a* . . . Body
10*b* . . . Coating Layer
10*c* . . . Irregular Surface
11 . . . Support Member
12 . . . Flight Tube
13 . . . Reflector
14 . . . Orthogonal Acceleration Unit
15 . . . Ion Detector
16 . . . Temperature Control Unit

The invention claimed is:

1. A time-of-flight mass spectrometer, comprising:

a chamber whose inside is maintained in vacuum; a flight tube disposed inside of the chamber and separated from an inner wall of the chamber; and a temperature control unit configured to control temperature outside the chamber, wherein a radiation factor improvement treatment is done to a part of an inner wall surface of the chamber facing the flight tube.

2. The time-of-flight mass spectrometer according to claim 1, wherein the radiation factor improvement treatment is a surface treatment for an inner wall surface of a material forming the chamber.

3. The time-of-flight mass spectrometer according to claim 2, wherein the surface treatment is a coating film formation treatment of forming a thin coating film on a surface of a material forming the chamber.

4. The time-of-flight mass spectrometer according to claim 3, wherein the chamber is made of aluminum, and the surface treatment is an alumite forming treatment.

5. The time-of-flight mass spectrometer according to claim 4, wherein the alumite forming treatment is a black alumite forming treatment.

6. The time-of-flight mass spectrometer according to claim 3, wherein the surface treatment is a nickel plating treatment.

7. The time-of-flight mass spectrometer according to claim 6, wherein the nickel plating treatment is a black nickel plating treatment.

8. The time-of-flight mass spectrometer according to claim 3, wherein the surface treatment is a carbon coating film formation treatment.

9. The time-of-flight mass spectrometer according to claim 3, wherein the surface treatment is a ceramic thermal spraying treatment.

10. The time-of-flight mass spectrometer according to claim 2, wherein the surface treatment is a processing treatment of roughening a surface of a material forming the chamber by chemically or physically shaving the surface.

11. The time-of-flight mass spectrometer according to claim 1, wherein the radiation factor improvement treatment is a treatment of attaching a thin plate or thin foil of another material to an inner wall surface of a material forming the chamber.

* * * * *